US012084932B2

(12) United States Patent
Dave et al.

(10) Patent No.: US 12,084,932 B2
(45) Date of Patent: Sep. 10, 2024

(54) PACKER SETTING MECHANISM WITH SETTING LOAD BOOSTER

(71) Applicant: Halliburton Energy Services, Inc., Houston, TX (US)

(72) Inventors: Jalpan Piyush Dave, Singapore (SG); Shanu Thottungal Eldho, Singapore (SG); Luke William Holderman, Singapore (SG)

(73) Assignee: Halliburton Ener y Services, Inc., Houston, TX (US)

( * ) Notice: Subject to any disclaimer, the term of this patent is extended or adjusted under 35 U.S.C. 154(b) by 169 days.

(21) Appl. No.: 17/680,982

(22) Filed: Feb. 25, 2022

(65) Prior Publication Data

US 2023/0272685 A1 Aug. 31, 2023

(51) Int. Cl.
*E21B 23/06* (2006.01)
*E21B 33/12* (2006.01)

(52) U.S. Cl.
CPC ..... *E21B 23/06* (2013.01); *E21B 33/1208* (2013.01)

(58) Field of Classification Search
CPC ..... E21B 23/06; E21B 33/1208
See application file for complete search history.

(56) References Cited

U.S. PATENT DOCUMENTS

| | | | | |
|---|---|---|---|---|
| 4,444,252 | A | 4/1984 | Fisher, Jr. | |
| 5,375,662 | A | 12/1994 | Echols, III et al. | |
| 6,902,008 | B2 | 6/2005 | Hirth et al. | |
| 8,881,836 | B2 | 11/2014 | Ingram | |
| 10,590,732 | B2 | 3/2020 | Ingram | |
| 2015/0240597 | A1* | 8/2015 | Ross | E21B 34/066 166/66.7 |
| 2015/0337624 | A1* | 11/2015 | Themig | E21B 34/063 166/317 |
| 2016/0115762 | A1* | 4/2016 | O'Dwyer | E21B 33/12 166/134 |
| 2017/0081940 | A1* | 3/2017 | Themig | E21B 23/06 |
| 2018/0148992 | A1* | 5/2018 | Vasques | E21B 47/06 |
| 2020/0173245 | A1* | 6/2020 | Prasad | E21B 33/128 |

FOREIGN PATENT DOCUMENTS

| | | |
|---|---|---|
| CN | 113338841 | 9/2021 |
| EP | 3663510 | 10/2020 |
| WO | 2008021703 | 2/2008 |

OTHER PUBLICATIONS

"PCT Application No. PCT/US2022/018088, International Search Report and Written Opinion", Nov. 14, 2022, 10 pages.

* cited by examiner

*Primary Examiner* — Theodore N Yao
(74) *Attorney, Agent, or Firm* — DeLizio, Peacock, Lewin & Guerra, LLP

(57) ABSTRACT

A mechanism for setting a packer comprises a piston disposed within a port of a packer mandrel, wherein the port comprises a seat operable to receive the piston. The mechanism further comprises a first chamber disposed at a first end of the piston, wherein the first chamber is sealed and comprises atmospheric pressure. The mechanism further comprises a spring disposed at a second end of the piston. The mechanism further comprises a second chamber disposed at the second end of the piston, wherein the second chamber comprises atmospheric pressure.

18 Claims, 3 Drawing Sheets

PACKER SETTING MECHANISM WITH SETTING LOAD BOOSTER

TECHNICAL FIELD OF THE INVENTION

The present disclosure relates generally to well operations and, more particularly, to a packer setting mechanism with setting load booster.

BACKGROUND

It is well known in the subterranean well drilling and completion art to locate a downhole tool string within a casing, liner, or production tubing to perform desired operations. Such a tool string may incorporate a variety of tools including sliding sleeves, circulating subs, packers, and the like. Once the tool string is properly positioned downhole, actuation of one or more of the downhole tools in the string may be desired. One method to actuate such downhole tools involves increasing fluid pressure above a certain threshold to actuate the packer setting mechanism, which in turn sets the packer to engage the casing, liner, or production tubing.

Fluctuations in the temperature in a downhole environment may adversely affect the operation of packers. For example, slack or a reduction in contact pressure between the packer element and the wellbore may be produced from thermal cycling, thereby reducing performance. The reduction in contact pressure and/or element internal pressure can also arise when a pressure differential is applied on the packer element and subsequently this pressure differential is released or is then applied on the other side of the packing element. This causes the element to take a compression set thereby reducing the internal pressure of the element and the contact pressure between the element and wellbore, casing, or mandrel. This reduction in contact pressure is known to poorly affect the performance of the packer element.

BRIEF DESCRIPTION OF THE DRAWINGS

These drawings illustrate certain aspects of some of the embodiments of the present disclosure and should not be used to limit or define the claims.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure involving wellbores may be applicable to horizontal, vertical, deviated, or otherwise nonlinear wellbores in any type of subterranean formation. Embodiments may be applicable to injection wells, monitoring wells, and production wells, including hydrocarbon or geothermal wells.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

The present disclosure provides for systems and methods for accommodating large thermal swings in a downhole environment and/or a large number of pressure differentials across a packer element. Systems and methods may provide additional setting force when slack, or a reduction in contact pressure, is created between a packer and a wellbore due to thermal cycling and/or due to numerous pressure differentials across the element. A packer setting mechanism may have the ability to autonomously apply additional setting force on the packer element and lock in this setting force permanently by making the lock ring ratchet. This may enhance performance of the packer element in situations where the element has a tendency to become unseated. Such situations can arise from thermal cycling, pressure reversals and others.

Figure 1:
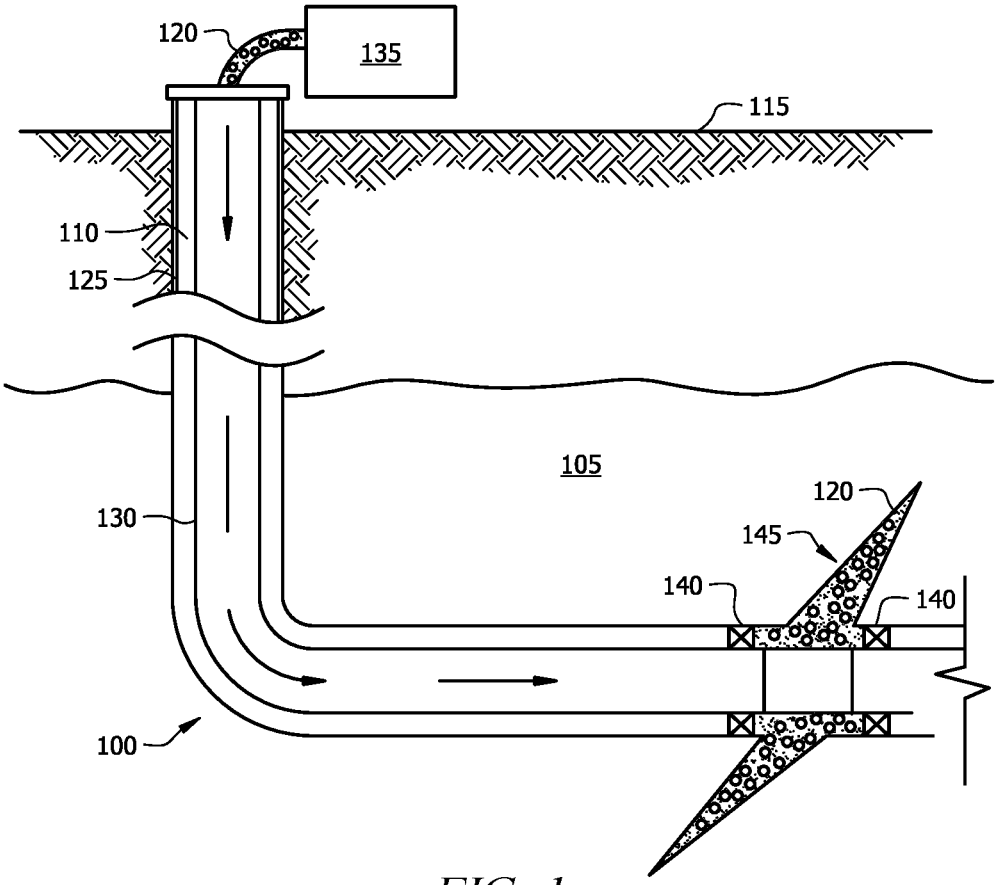
FIG. 1 is a diagram illustrating an example of a subterranean formation in which a fracturing operation may be performed in accordance with certain embodiments of the present disclosure.

FIG. 1 shows the well 100 during a fracturing operation in a portion of a subterranean formation of interest 105 surrounding a wellbore 110. The wellbore 110 extends from the surface 115, and the fracturing fluid 120 is applied to a portion of the subterranean formation 105 surrounding the horizontal portion of the wellbore. Although shown as vertical deviating to horizontal, the wellbore 110 may include horizontal, vertical, slant, curved, and other types of wellbore geometries and orientations, and the fracturing treatment may be applied to a subterranean zone surrounding any portion of the wellbore. The wellbore 110 can include a casing 125 that is cemented or otherwise secured to the wellbore wall. The wellbore 110 can be uncased or include uncased sections. Perforations can be formed in the casing 125 to allow fracturing fluids and/or other materials to flow into the subterranean formation 105. In cased wells, perforations can be formed using shape charges, a perforating gun, hydro jetting and/or other tools.

The well is shown with a work string 130 depending from the surface 115 into the wellbore 110. The pump and blender system 135 is coupled a work string 130 to pump the fracturing fluid 120 into the wellbore 110. The work string 130 may include coiled tubing, jointed pipe, and/or other structures that allow fluid to flow into the wellbore 110. The work string 130 can include flow control devices, bypass valves, ports, and or other tools or well devices that control a flow of fluid from the interior of the work string 130 into the subterranean zone 105. For example, the work string 130 may include ports adjacent the wellbore wall to communicate the fracturing fluid 120 directly into the subterranean formation 105, and/or the work string 130 may include ports that are spaced apart from the wellbore wall to communicate the fracturing fluid 120 into an annulus in the wellbore between the work string 130 and the wellbore wall.

The work string 130 and/or the wellbore 110 may include one or more sets of packers 140 that seal the annulus between the work string 130 and wellbore 110 to define an interval of the wellbore 110 into which the fracturing fluid 120 will be pumped. FIG. 1 shows two packers 140, one defining an uphole boundary of the interval and one defining the downhole end of the interval. When the fracturing fluid 120 is introduced into wellbore 110 (e.g., in FIG. 1, the area of the wellbore 110 between packers 140) at a sufficient hydraulic pressure, one or more fractures 145 may be created in the subterranean zone 105. The proppant particulates in the fracturing fluid 120 may enter the fractures 145 where they may remain after the fracturing fluid flows out of the wellbore. These proppant particulates may "prop" fractures 145 such that fluids may flow more freely through the fractures 145.

A person skilled in the art, with the benefit of this disclosure, will recognize that while FIG. 1 depicts a singular well 100, there may be a plurality of wells 100 undergoing a treatment. In certain embodiments, the injection flow rate for a singular well 100 containing several intervals of interest may be determined by the injection rate per perforation and the number of perforations per cluster for each interval of interest. In embodiments, each interval of interest may comprise one or more clusters which may comprise one or more perforations. The injection flow rate for a given cluster may be determined by dividing the flow rate by the number of perforations. In these embodiments, both the minimum and maximum flow rates may be determined by analyzing the minimum and maximum number of perforations per cluster. In one or more embodiments where there is a plurality of wells 100, the total injection rate may be apportioned among the plurality of wells 100 involved in simultaneous fracturing treatments. In embodiments, the treatment fluid may be injected into each of the plurality of wells 100 simultaneously. In one or more embodiments, the injection flow rate may vary between each one of the plurality of wells 100 depending on the number of perforations within each well 100.

While not specifically illustrated herein, the disclosed methods and compositions may also directly or indirectly affect the various downhole equipment and tools that may come into contact with the treatment fluids during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIG. 1.

Figure 2:
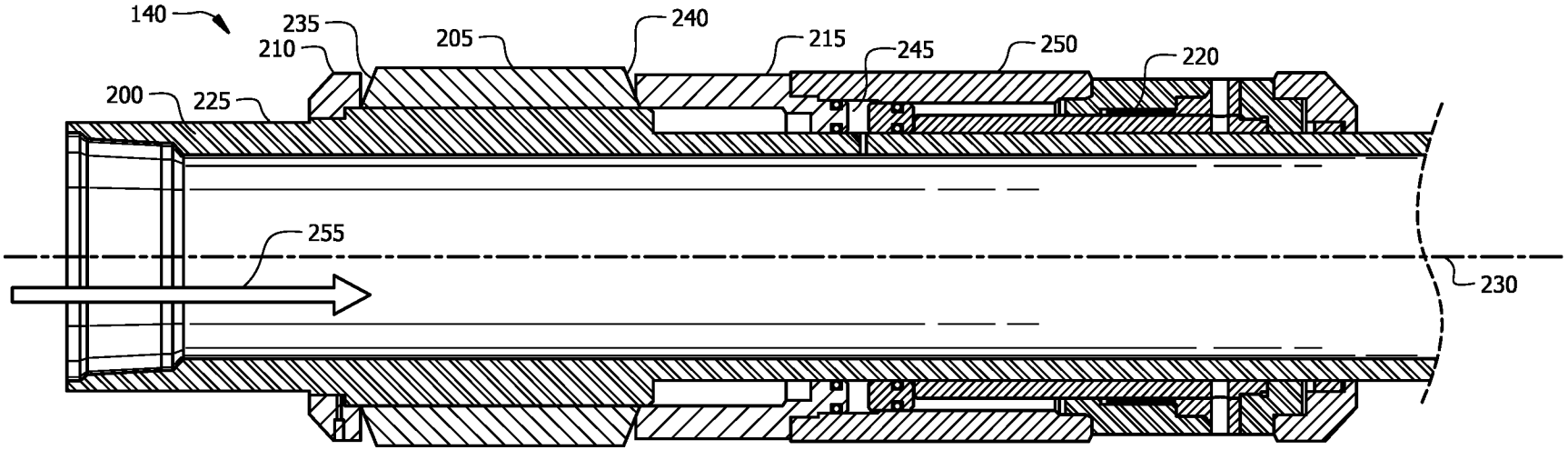
FIG. 2 is a diagram illustrating an example packer in accordance with certain embodiments of the present disclosure.

FIG. 2 illustrates an example packer 140 to be used in conjunction with the work string 130 (referring to FIG. 1), a wireline, or any other suitable conveyance. Without limitations, the packer 140 may be secured to the work string 130 through any suitable method, including through the usage of fasteners, adhesives, interlocking components, interference fit, and any combination thereof. The packer 140 may be operable to radially expand a component commonly referred to in the art as a packing element in order to engage with a wall of the wellbore 110 (referring to FIG. 1) and provide a seal. The packer 140 may comprise any suitable size, height, shape, and any combinations thereof. Further, the packer 140 may comprise any suitable materials, such as metals, nonmetals, polymers, composites, and any combinations thereof. As illustrated, the packer 140 may comprise a packer mandrel 200, an isolation element 205, a retaining shoe 210, a setting piston 215, and a lock ring 220. The packer mandrel 200 may be adapted for connection to a tubing string (for example, work string 130) and operable to function as a base on which other components of packer 140 may be arranged. In one or more embodiments, the packer mandrel 200 generally comprises a cylindrical or tubular structure or body. The packer mandrel 200 may comprise a unitary structure (e.g., a single unit of manufacture, such as a continuous length of pipe or tubing); alternatively, the packer mandrel 200 may comprise two or more operably connected components (e.g., two or more coupled sub-components, such as by a threaded connection). The tubular body of the packer mandrel 200 may generally define a continuous axial flow bore that allows fluid movement through the packer mandrel 200.

In one or more embodiments, the packer mandrel 200 may be configured for incorporation into the work string 130. The packer mandrel 200 may further be configured for incorporation into any suitable tubular string, such as for example a work string, a tool string, a wireline, a segmented tubing string, a jointed pipe string, a coiled tubing string, a production tubing string, a drill string, the like, or combinations thereof. In such embodiments, the packer mandrel 200 may comprise a suitable connection to the work string 130 (e.g., to a casing string member, such as a casing joint). Suitable connections to a casing string will be known to those of skill in the art. In embodiments, the packer mandrel 200 may be incorporated within the work string 130 such that the axial flow bore of the packer mandrel 200 is in fluid communication with the axial flow bore of the work string 130.

The isolation element 205 may be disposed around an outer surface 225 of the packer mandrel 200. The isolation element 205 may be a singular unit or may comprise a plurality of smaller units. The isolation element 205 may be operable to expand or inflate in a radial direction with reference to a central axis 230 of the packer 140 in order to engage with the wellbore 110. Further, the isolation element 205 may comprise any suitable materials, such as metals, nonmetals, polymers, composites, and any combinations thereof. For example, the isolation element 205 comprises a resilient (e.g., elastic) material capable of expanding (and, in some instances, relaxing from an expanded configuration) to provide a fluid seal between an uphole section and downhole section of a wellbore 110 at the location wherein the isolation element 205 engages with the wall of the wellbore 110. The isolation element 205 may comprise an elastomeric material, including non-degradable and/or degradable elastomeric materials. For example, an elastomer for forming the isolation element 205 may include, but is not limited to, polypropylene, polyethylene, styrene divinyl benzene, polyisoprene, polybutadiene, polyisobutylene, polyurethane, a block polymer of styrene, a styrene-isoprene block copolymer, a styrene-butadiene random copolymer, a styrene-butadiene block copolymer, acrylonitrile butadiene, acrylonitrile-styrene-butadiene, natural rubber, polyurethane rubber, polyester-based polyurethane rubber, polyether-based polyurethane rubber, a thiol-based rubber, a hyaluronic acid rubber, a polyhydroxobutyrate rubber, a nitrile rubber, ethylene propylene rubber, ethylene propylene diene M-class rubber, polyisobutene rubber, hydrogenated nitrile rubber, acrylate butadiene rubber, polyacrylate rubber, butyl rubber, norbornene rubber, polynorbornene rubber, isobutylene rubber, brominated butyl rubber, chlorinated butyl rubber, chlorinated polyethylene rubber, isoprene rubber, choloroprene rubber, neoprene rubber, butadiene rubber, styrene butadiene copolymer rubber, sulphonated polyethylene, ethylene acrylate rubber, epichlorohydrin ethylene oxide copolymer rubber, ethylene-propylene-copolymer that is peroxide cross-linked, ethylene-propylene-copolymer that is sulphur cross-linked, ethylene-propylene-diene terpolymer rubber, ethylene vinyl acetate copolymer, a fluoro rubber, a fluoro silicone rubber, a silicone rubber, poly 2,2,1-bicyclo heptene (polynorborneane), alkylstyrene, crosslinked substituted vinyl acrylate copolymer, polymethacrylate, polyacrylamide, a non-soluble acrylic polymer, starch-polyacrylate acid graft copolymer and salts thereof, a polyethylene oxide polymer, a carboxymethyl cellulose type polymer, poly(acrylic acid) and salts thereof, poly(acrylic-co-acrylamide) and salts thereof, graft-poly(ethylene oxide) of poly(acrylic acid) and salts thereof, poly(2-hydroxyethyl methacrylate), poly(2-hydroxypropyl methacrylate), polyvinyl alcohol cyclic acid anhydride graft copolymer, isobutylene maleic anhydride, vinylacetate-acrylate copolymer, starch-polyacrylonitrile graft copolymer, a polyester elastomer; a polyester amide elastomer; a starch-based resin (e.g., starch-poly(ethylene-co-vinyl alcohol), a starch-polyvinyl alcohol, a starch-polylactic acid, starch-polycaprolactone, starch-poly(butylene succinate), and the like); a polyethylene terephthalate polymer; a polyester thermoplastic (e.g., polyether/ester copolymers, polyester/ester copolymers, and the like); copolymers thereof; terpolymers thereof; and any combination thereof.

As illustrated, the retaining shoe 210 may be disposed around the outer surface 225 of the packer mandrel 200 and adjacent to the isolation element 205. In embodiments, the retaining shoe 210 may be disposed at a first side 235 of the isolation element 205. The retaining shoe 210 may be operable to inhibit movement of the isolation element 205 as the isolation element 205 experiences a force in order to expand. The retaining shoe 210 may force the isolation element 205 to expand radially when experiencing a compressive force. The retaining shoe 210 may comprise any suitable size, height, shape, and any combinations thereof. Further, the retaining shoe 210 may comprise any suitable materials, such as metals, nonmetals, polymers, composites, and any combinations thereof. Without limitations, the retaining shoe 210 may be secured to the packer mandrel 200 through any suitable method, including through the usage of fasteners, adhesives, interlocking components, interference fit, and any combination thereof.

The setting piston 215 may be disposed around the outer surface 225 of the packer mandrel 200 and adjacent to the isolation element 205. In embodiments, the setting piston 215 may be disposed at a second side 240 of the isolation element 205 opposite from the retaining shoe 210. The setting piston 215 may be operable to apply a compressive force to the isolation element 205. The setting piston 215 may force the isolation element 205 against the retaining shoe 210 in order to expand radially. The setting piston 215 may comprise any suitable size, height, shape, and any combinations thereof. Further, the setting piston 215 may comprise any suitable materials, such as metals, nonmetals, polymers, composites, and any combinations thereof. Without limitations, the setting piston 215 may be secured to the packer mandrel 200 through any suitable method, including through the usage of fasteners, adhesives, interlocking components, interference fit, and any combination thereof. As illustrated, at least a portion of the setting piston 215 may be disposed within an internal chamber 245, wherein the internal chamber 245 is disposed between the outer surface 225 of the packer mandrel 200 and an external housing 250. The external housing 250 may be any suitable tubular connection operable to protect the packer mandrel 200 from an external environment. The external housing 250 may be coupled to the packer mandrel 200 through any suitable means. In one or more embodiments, a fluid 255 may be introduced into the packer mandrel 200 and directed into the internal chamber 245. The introduction of the fluid 255 may pressurize the internal chamber 245 and force the setting piston 215 to translate along at least a portion of the length of the internal chamber 245 towards the isolation element 205. The fluid pressure from the internal chamber 245 may force the setting piston 215 against the isolation element 205 to cause the isolation element 205 to expand due to the retaining shoe 210 inhibiting motion of the isolation element 205 on an opposite side of the setting piston 215.

In one or more embodiments, as the setting piston 215 translates in a lateral direction parallel to the central axis 230 of the packer mandrel 200, the lock ring 220 may ratchet against the packer mandrel 200. As illustrated, the lock ring 220 may be disposed around the packer mandrel 200. In embodiments, the lock ring 220 may be disposed about the outer surface 225 or around an intermediate coupling component external to the packer mandrel 200. The lock ring 220 may be in ratcheting engagement with the packer mandrel 200. The lock ring 220 may include a plurality of ramped teeth defined on an inner radial surface. The outer surface 225 or intermediate coupling component external to the packer mandrel 200 may likewise define a plurality of ramped teeth on an outer radial surface, wherein the ramped teeth of the lock ring 220 may be configured to engage the ramped teeth of the outer surface 225 or intermediate coupling component external to the packer mandrel 200. As the setting piston 215 moves uphole, as described above, the respective ramped teeth of both components may come into contact with each other. The ramped teeth may be angled such that movement of the setting piston 215 in the uphole direction is allowed and subsequently ratchets the lock ring 220 in the uphole direction. The ramped teeth, however, may further be angled such that movement of the setting piston 215 in the downhole direction is prevented. Accordingly, once the fluid pressure within the packer 140 decreases, transitioning back to an initial position may be prohibited. One skilled in the art will recognize that what is shown is a single piston uni-directional packer design, but this does not limit the scope of the present disclosure. The present disclosure may be deployed in a packer with multiple pistons including in packers where there is at least one piston on either side of the packing element.

Figure 3:
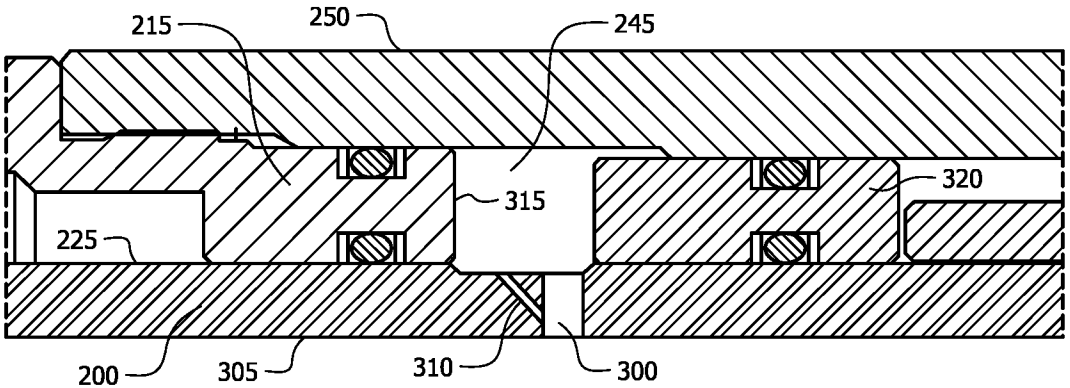
FIG. 3 is a diagram illustrating an example subsection of the packer of FIG. 2 in accordance with certain embodiments of the present disclosure.

FIG. 3 illustrates a subsection of the example packer 140 (referring to FIG. 2). As illustrated, the packer mandrel 200 may comprise a port 300, wherein the port 300 may provide fluid communication between an inner surface 305 of the packer mandrel 200 and the outer surface 225. The port 300 may comprise any suitable size, height, shape, and any combinations thereof. In one or more embodiments, the port 300 may be closed, sealed, or otherwise inhibit fluid from flowing into the internal chamber 245. There may be a flow path 310 extending from the port 300 to the internal chamber 245, wherein a first end 315 of the setting piston 215 may be operable to receive a fluid (i.e., fluid 255 in FIG. 2) introduced into the internal chamber 245 through the flow path 310. The flow path 310 may comprise any suitable size, height, shape, and any combinations thereof. As illustrated, the internal chamber 245 may be defined by the outer surface 225 of the packer mandrel 200 and the external housing 250, wherein at least a portion of the setting piston 215 is disposed within the internal chamber 245. In one or more embodiments, the internal chamber 245 may be pressurized by the introduction of a fluid. As the pressure increases, the setting piston 215 may be actuated to translate. There may be a stationary piston 320 disposed within the internal chamber 245 downhole from the setting piston 215 operable to prevent fluid from flowing further downhole, wherein the stationary piston 320 may remain stationary throughout operation of the packer 140.

Figure 4:
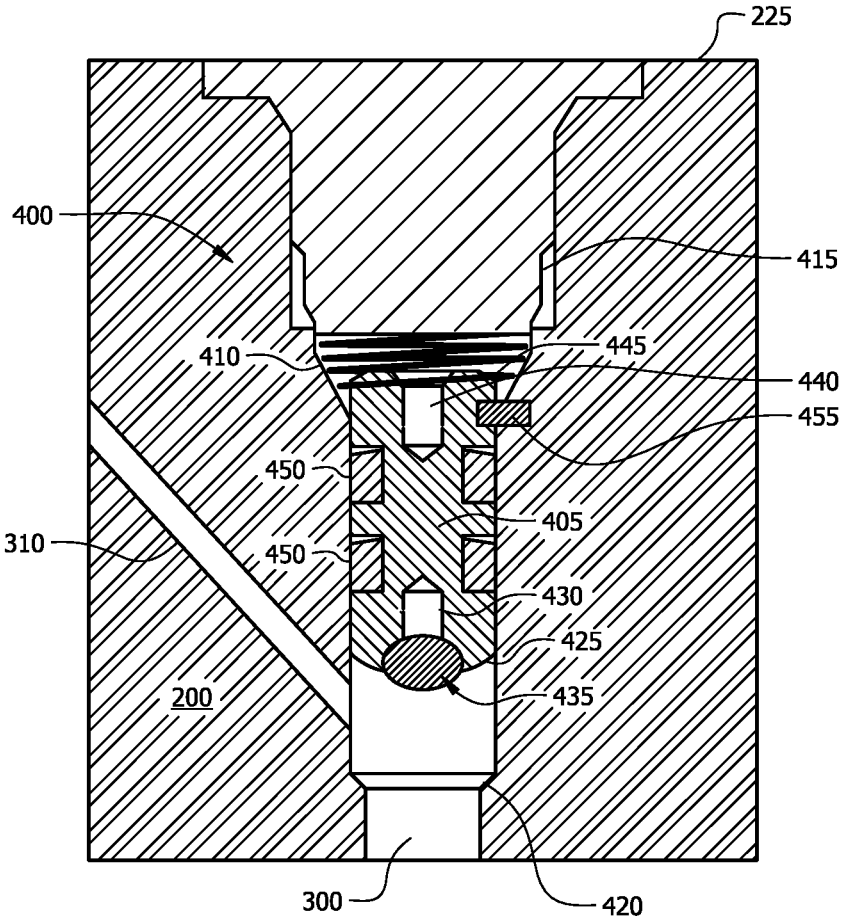
FIG. 4 is a diagram illustrating an example setting mechanism in accordance with certain embodiments of the present disclosure.

FIG. 4 illustrates an example setting mechanism 400 disposed in the packer mandrel 200. The setting mechanism 400 may be operable to trap pressure within the internal chamber 245 (referring to FIG. 2) to be used in response to a reduction of contact pressure between the isolation element 205 (referring to FIG. 2) and the wellbore 110 (referring to FIG. 1). Without limitations, the setting mechanism 400 may be secured to the packer mandrel 200 through any suitable method, including through the usage of fasteners, adhesives, interlocking components, interference fit, and any combination thereof. The setting mechanism 400 may comprise any suitable size, height, shape, and any combinations thereof. Further, the setting mechanism 400 may comprise any suitable materials, such as metals, nonmetals, polymers, composites, and any combinations thereof. As illustrated, the setting mechanism 400 may comprise a piston 405, a spring 410, and a fastener 415.

The piston 405 may comprise any suitable size, height, shape, and any combinations thereof. Further, the piston 405 may comprise any suitable materials, such as metals, nonmetals, polymers, composites, and any combinations thereof. As illustrated, the piston 405 may be disposed within the port 300 of the packer mandrel 200. The port 300 may comprise a seat 420 operable to receive a first end 425 of the piston 405 during operations. The piston 405 may comprise a first chamber 430 disposed at the first end 425, wherein the first chamber 430 may be sealed and comprising atmospheric pressure. As shown, a seal 435 may be applied to seal the first chamber 430. In other embodiments, the first chamber 430 may be sealed using any other suitable methods, including threading fasteners, welding, adhesives, and the like. In one or more embodiments, a second chamber 440 may be disposed at a second end 445 of the piston 405, which is opposite from the first end 425. The second chamber 440 may also comprise atmospheric pressure. Further, there may be one or more seals 450 disposed around the piston 405 operable to seal the piston 405 to the interior of the port 300. Without limitations, the one or more seals 450 may be O-rings. A shear device 455 may initially couple the piston 405 to the port 300. Upon pressurization by introduction of a fluid (for example, fluid 255 of FIG. 2), the shear device 455 may be sheared. Without limitations, a suitable shear device 455 may be a shear ring, a shear pin, or a shear screw.

As illustrated, the spring 410 may be disposed at the second end 445 of the piston 405. The spring 410 may be any suitable elastic object capable of storing mechanical energy. The spring 410 may be configured to remain at atmospheric pressure, wherein the second chamber 440 is open to the area of the port 300 between the fastener 415 and the second end 445 of the piston 405. The spring 410 may be disposed between the piston 405 and the fastener 415. The fastener 415 may be disposed along the outer surface 225 of the packer mandrel 200 operable to seal the piston 405 within the port 300. The fastener 415 may form a seal with the packer mandrel 200 preventing pressure in port 300, flow path 310 and internal chamber 245 from acting on the second end 445 of the piston 405. This seal may be metal-to-metal, elastomeric and any other appropriate seal. Without limitations, the fastener 415 may be any suitable fastener. In one or more embodiments, the fastener 415 may create a metal-to-metal seal between the fastener 415 and the port 300, wherein the spring 410 is disposed between the fastener 415 and the piston 405. Without limitations, the fastener 415 may be a plug, a threaded screw with O-rings, a threaded metal to metal seal device, a rupture device or other similar devices that can act as both a fastener and a seal. During operations, as the pressure increases, the piston 405 may apply force against the spring 410 to compress the spring 410. When the pressure decreases, the spring 410 may decompress and expand to force the piston 405 to translate through the port 300 and to rest against the seat 420. As illustrated, the positioning of the piston 405 within the seat 420 may block the flow path 310 from the port 300. This may preserve or trap the fluid pressure within the internal chamber 245.

With reference to FIGS. 1-4, a method as presented in the present disclosure may be described. The packer 140 may be conveyed downhole to a target location (not shown) within the wellbore 110. At the target location, the packer 140 may be actuated or "set" to seal the wellbore 110 and otherwise provide a point of fluid isolation within the wellbore 110.

During operations, the method may include introducing the fluid 255 into the packer mandrel 200 to set the packer 140. The fluid 255 may be directed through the port 300, into the flow path 310 extending from the port 300, and into the internal chamber 245. As the fluid 255 flows into the port 300, the shear device 455 may shear, thereby decoupling the piston 405 from the inside of the port 300. The piston 405 may be free to translate. In embodiments, the fluid pressure may force the piston 405 against the spring 410, thereby compressing the spring 410 against the fastener 415. As the fluid 255 continues to flow, the pressure within the internal chamber 245 may increase and force the setting piston 215 to translate towards a direction of the isolation element 205. As the setting piston 215 compresses the isolation element 205 against the retaining shoe 210, the isolation element 205 may expand radially to engage with the wellbore 110. Further, as the setting piston 215 translates, subsequent components of the packer 140, such as the external housing 250 may translate concurrently with the movement of the setting piston 215. The lock ring 220 may be actuated to ratchet against the outer surface 225 of the packer mandrel 200 in the same direction as the movement of the setting piston 215. Ratcheting up the lock ring 220 against the outer surface 225 may effectively lock the position of the setting piston 215 against the isolation element 205.

Once setting is complete, there may be a decrease in the fluid pressure. As the fluid pressure decreases, the spring 410 may expand and force the piston 405 to translate within the port 300 and to seat against the seat 420. This may block the flow path 310 from the port 300, thereby trapping the fluid pressure within the internal chamber 245. In one or more embodiments wherein there is a reduction in the contact pressure between the isolation element 205 and the wellbore 110, such as through thermal cycling, the trapped fluid pressure may force the setting piston 215 to further translate into and/or towards the isolation element 205. As such, the lock ring 220 may be actuated to further ratchet against the outer surface 225 of the packer mandrel 200 to maintain this position. This increases the internal pressure of the isolation element 205 and the contact pressure between the isolation element 205 and the wellbore 110 thereby enhancing its performance.

One skilled in the art will recognize that typically, a spring adjacent to piston 215 housed inside a housing may be used to allow for slack adjustment in a packer element or slip system. However, such springs do not make the lock ring ratchet and thus, cannot permanently lock in an additional setting force on the packing element or slip.

One skilled in the art will recognize that hydrostatically set packers may be able to sidestep the challenge of slack adjustment in the packer element and/or slips because the hydrostatic pressure continuously acts on the setting mechanism. However, hydrostatic packers are more expensive to build and deploy and due to the nature of their setting process, may not always be preferred over hydraulically set packers.

One skilled in the art will further recognize that though the present disclosure describes the setting mechanism being used to apply additional setting load on a packing element, said setting mechanism may be adjusted to apply additional load to packer slips without departing from the scope of the present disclosure.

An embodiment of the present disclosure is a mechanism for setting a packer, comprising: a piston disposed within a port of a packer mandrel, wherein the port comprises a seat operable to receive the piston; a chamber disposed at an end of the piston, wherein the chamber comprises atmospheric pressure; and a spring disposed at the end of the piston, wherein the spring is in fluid communication with the chamber and at atmospheric pressure.

In one or more embodiments described in the preceding paragraph, further comprising a fastener disposed at an outer surface of the packer mandrel operable to seal the piston within the port. In one or more embodiments described above, wherein there is a metal-to-metal seal between the fastener and the port, wherein the spring is disposed between the fastener and the piston. In one or more embodiments described above, further comprising one or more seals disposed around the piston. In one or more embodiments described above, wherein the port is fluidly coupled to a flow path extending from the port to an internal chamber disposed between the outer surface of the packer mandrel and an external housing. In one or more embodiments described above, further comprising a shear device operable to couple the piston to the port.

Another embodiment of the present disclosure is a method for setting a packer, comprising: introducing a fluid into a packer mandrel to provide pressure for setting the packer; introducing the fluid into a port disposed in the packer mandrel, wherein the fluid is directed into an internal chamber via a flow path extending from the port; shearing a shear device securing a piston within the port; compressing a spring disposed between the piston and a fastener disposed at an outer surface of the packer mandrel operable to seal the piston within the port; and compressing an isolation element to expand in a radial direction to engage with a wellbore, wherein compressing the isolation element further comprises of ratcheting a lock ring that is in ratcheting engagement with the outer surface of the packer mandrel.

In one or more embodiments described in the preceding paragraph, further comprising translating a setting piston disposed adjacent to the isolation element to compress the isolation element in response to directing the fluid into the internal chamber. In one or more embodiments described above, further comprising expanding the spring in response to a reduction in fluid pressure provided by the fluid. In one or more embodiments described above, wherein the piston translates to abut a seat disposed within the port. In one or more embodiments described above, further comprising releasing pressure trapped within the internal chamber in response to a reduction of contact pressure between the isolation element and the wellbore. In one or more embodiments described above, wherein the lock ring ratchets an additional distance closer to the isolation element. In one or more embodiments described above, further comprising disposing the packer downhole into the wellbore.

A further embodiment of the present disclosure is a packer, comprising: a packer mandrel; an isolation element disposed around an outer surface of the packer mandrel; a setting piston disposed around the outer surface of the packer mandrel and adjacent to a side of the isolation element, wherein the setting piston is operable to compress the isolation element; a lock ring in ratcheting engagement with the outer surface of the packer mandrel; and a setting mechanism disposed in the packer mandrel, wherein the setting mechanism comprises: a piston disposed within a port of the packer mandrel, wherein the port comprises a seat operable to receive the piston; a chamber disposed at an end of the piston, wherein the chamber comprises atmospheric pressure; and a spring disposed at the end of the piston, wherein the spring is in fluid communication with the chamber and at atmospheric pressure.

In one or more embodiments described in the preceding paragraph, further comprising an internal chamber disposed between the outer surface of the packer mandrel and an external housing, wherein at least a portion of the setting piston is disposed within the internal chamber and operable to translate along the internal chamber. In one or more embodiments described above, further comprising a flow path extending from the port to the internal chamber, wherein a first end of the setting piston is operable to receive a fluid introduced into the internal chamber through the flow path. In one or more embodiments described above, wherein the setting mechanism further comprises a fastener disposed at the outer surface of the packer mandrel operable to seal the piston within the port. In one or more embodiments described above, wherein there is a metal-to-metal seal between the fastener and the port, wherein the spring is disposed between the fastener and the piston. In one or more embodiments described above, wherein the setting mechanism further comprises one or more seals disposed around the piston. In one or more embodiments described above, wherein the setting mechanism further comprises a shear device operable to couple the piston to the port.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

What is claimed is:

1. A mechanism for setting a packer, comprising:

a piston disposed within a port of a packer mandrel, wherein the port comprises a passageway extending within the packer mandrel between a sealed area enclosed within the packer mandrel and a first opening of the port that is in fluid communication with an axial flow bore extending through the packer mandrel, and wherein the piston comprises a first end extending across the port and facing the first opening of the port and a second end extending across the port and forming one side of the sealed area enclosed within the packer mandrel, wherein an outer shape and a maximum dimension of the piston in cross-section at the first end of the piston are the same as an outer shape and a maximum dimension of the piston in cross-section at the second end of the piston;

a seat positioned within the port and above the first opening, the seat configured to receive the first end of the piston; and a spring positioned within the sealed area of the packer mandrel and configured to exert a downward force in a direction of the seat on the second end of the piston; and wherein the piston is configured to move in an upward direction away from the seat and against the downward force exerted by the spring on the second end of the piston when a threshold level of fluid pressure provided in the axial flow bore of the packer mandrel is exerted on the first end of the piston through the first opening in the port, and wherein movement of the piston in the upward direction is configured to expose a flow path extending from within the port to an internal chamber and a setting piston positioned within the packer mandrel, the flow path, when exposed, configured to provide the fluid pressure provided at the first opening of the port to the setting piston and thereby to apply a compressive force to one or more isolation elements of the packer mandrel, wherein the compressive force applied to the one or more isolation element by the setting piston is configured to expand the one or more isolation elements to engage a wall of a wellbore.

2. The mechanism of claim 1, further comprising a fastener disposed at an outer surface of the packer mandrel operable to seal the piston within the port.

3. The mechanism of claim 2, wherein there is a metal-to-metal seal between the fastener and the port, wherein the spring is disposed between the fastener and the piston.

4. The mechanism of claim 1, further comprising one or more seals disposed around the piston, the one or more seals configured to isolate the second end of the piston from the fluid pressure provided at the first end of the piston.

5. The mechanism of claim 1, further comprising a shear device operable to couple the piston to the port.

6. The mechanism of claim 5, wherein the shear device is operable to be sheared when a level of fluid pressure is introduced in the axial flow bore and applied to the first end of the piston through the first opening of the port, and wherein the piston is allowed to move within the port once the shear device has been sheared.

7. The mechanism of claim 1, wherein the internal chamber is isolated from the fluid pressure provided at the first opening of the port when the first end of the piston is received at the seat.

8. The mechanism of claim 1, wherein the flow path is isolated from the fluid pressure provided at the first opening of the port when the first end of the piston is received at the seat.

9. A packer, comprising:

a packer mandrel;

an isolation element disposed around an outer surface of the packer mandrel;

a setting piston disposed around the outer surface of the packer mandrel and adjacent to a side of the isolation element, wherein the setting piston is operable to compress the isolation element;

a lock ring in ratcheting engagement with the outer surface of the packer mandrel; and a setting mechanism disposed in the packer mandrel, wherein the setting mechanism comprises:

a piston disposed within a port of the packer mandrel, wherein the port comprises a passageway extending within the packer mandrel between a sealed area enclosed within the packer mandrel and a first opening of the port that is in fluid communication with an axial flow bore extending through the packer mandrel, and wherein the piston comprises a first end extending across the port and facing the first opening of the port and a second end extending across the port and forming one side of the sealed area enclosed within the packer mandrel, wherein an outer shape and a maximum dimension of the piston in cross-section at the first end of the piston are the same as an outer shape and a maximum dimension of the piston in cross-section at the second end of the piston;

a seat positioned within the port and above the first opening, the seat configured to receive the first end of the piston; and a spring positioned within the sealed area of the packer mandrel and configured to exert a downward force in a direction of the seat on the second end of the piston; and wherein the piston is configured to move in an upward direction away from the seat and against the downward force exerted by the spring on the second end of the piston when a threshold level of fluid pressure provided in the axial flow bore of the packer mandrel is exerted on the first end of the piston through the first opening in the port, and wherein movement of the piston in the upward direction is configured to expose a flow path extending from within the port to an internal chamber and the setting piston positioned within the packer mandrel, the flow path, when exposed, is configured to provide the fluid pressure provided at the first opening of the port to the setting piston and thereby to apply a compressive force to the isolation element of the packer mandrel, wherein the compressive force applied to the isolation elements by the setting piston is configured to expand the isolation element to engage a wall of a wellbore.

10. The packer of claim 9, wherein the internal chamber is disposed between the outer surface of the packer mandrel and an external housing, and wherein at least a portion of the setting piston is disposed within the internal chamber and operable to translate along the internal chamber.

11. The packer of claim 10, wherein a first end of the setting piston is operable to receive a fluid introduced into the internal chamber through the flow path.

12. The packer of claim 9, wherein the setting mechanism further comprises a fastener disposed at the outer surface of the packer mandrel operable to seal the piston within the port.

13. The packer of claim 12, wherein there is a metal-to-metal seal between the fastener and the port, wherein the spring is disposed between the fastener and the piston.

14. The packer of claim 9, wherein the setting mechanism further comprises one or more seals disposed around the piston, the one or more seals configured to isolate the second end of the piston from the fluid pressure provided at the first end of the piston.

15. The packer of claim 9, wherein the setting mechanism further comprises a shear device operable to couple the piston to the port.

16. The packer of claim 15, wherein the shear device is operable to be sheared when a level of fluid pressure is introduced in the axial flow bore and applied to the first end of the piston through the first opening of the port, and wherein the piston is allowed to move within the port once the shear device has been sheared.

17. The packer of claim 9, wherein the internal chamber is isolated from the fluid pressure provided at the first opening of the port when the first end of the piston is received at the seat.

18. The packer of claim 9, wherein the flow path is isolated from the fluid pressure provided at the first opening of the port when the first end of the piston is received at the seat.

* * * * *